US008142160B2

(12) United States Patent
Yoo et al.

(10) Patent No.: US 8,142,160 B2
(45) Date of Patent: Mar. 27, 2012

(54) HIGH SPEED TYPE IMPELLER HAVING A REINFORCING RING

(75) Inventors: Myung-Keun Yoo, Seoul (KR); Jun-Young Lim, Incheon (KR)

(73) Assignee: LG Electronics Inc., Seoul (KR)

( * ) Notice: Subject to any disclaimer, the term of this patent is extended or adjusted under 35 U.S.C. 154(b) by 1006 days.

(21) Appl. No.: 12/091,512

(22) PCT Filed: Oct. 24, 2006

(86) PCT No.: PCT/KR2006/004354

§ 371 (c)(1),
(2), (4) Date: Apr. 25, 2008

(87) PCT Pub. No.: WO2008/050915

PCT Pub. Date: May 2, 2008

(65) Prior Publication Data

US 2008/0286113 A1 Nov. 20, 2008

(51) Int. Cl.
*F04D 29/28* (2006.01)

(52) U.S. Cl. ..... 416/185; 416/204 R

(58) Field of Classification Search ..... 416/185, 416/204 R

See application file for complete search history.

(56) References Cited

U.S. PATENT DOCUMENTS

| | | | | |
|---|---|---|---|---|
| 5,632,601 | A * | 5/1997 | Bodmer et al. | 416/223 B |
| 5,800,128 | A * | 9/1998 | Bodmer et al. | 416/183 |
| 2005/0120533 | A1 | 6/2005 | Yoon et al. | |
| 2006/0013712 | A1 | 1/2006 | Lee et al. | |
| 2006/0182628 | A1 | 8/2006 | Kim et al. | |

FOREIGN PATENT DOCUMENTS

| | | | |
|---|---|---|---|
| GB | 761872 | * | 11/1956 |
| JP | 56132499 | * | 10/1981 |
| JP | 63-289298 | | 11/1988 |
| JP | 2-207195 | | 8/1990 |
| JP | 3-264798 | | 11/1991 |
| JP | 2002-213393 | | 7/2002 |
| JP | 2003269383 | * | 9/2005 |

OTHER PUBLICATIONS

JP56132499 abstract, Centrifugal Impeller, Oct. 16, 1981, Mori.*
JP2003269383 abstract, Impeller Structure of Compressor, Sep. 25, 2003, Kita et al.*
English language Abstract of JP 63-289298.
English language Abstract of JP 2-207195.
English language Abstract of JP 3-264798.
English language Abstract of JP 2002-213393.

* cited by examiner

*Primary Examiner* — Edward Look
*Assistant Examiner* — Liam McDowell
(74) *Attorney, Agent, or Firm* — KED & Associates, LLP

(57) ABSTRACT

Disclosed is a high speed type impeller, including: a body having a shaft coupling hole into which a rotation shaft of a motor is coupled, the outer circumference of the body being widened from the top to bottom end in the insertion direction of the rotation shaft to form a bent surface, a step portion shadowed in the radial direction being formed on the top end of the body; a plurality of blades installed on the bent surface of the body to be bent at a predetermined angle to the rotation shaft direction; and an upper reinforcing ring installed at the step portion of the body. Even through the impeller is made of a low cost material, the reinforcing ring reinforces the weak portion of the impeller to improve durability. Reliability of the impeller is attained with high economical efficiency.

18 Claims, 4 Drawing Sheets

Prior Art

Prior Art

HIGH SPEED TYPE IMPELLER HAVING A REINFORCING RING

TECHNICAL FIELD

The present invention relates to a high speed type impeller, and more particularly, to a high speed type impeller which can improve durability and economical efficiency, by reinforcing a weak portion made of a low cost material.

BACKGROUND ART

In general, an impeller is a rotating body for applying energy to a fluid in a pump, a ventilator, a compressor, etc. When the fluid passes between blades of the impeller rotated at a high speed, energy is supplied from the blades to the fluid, for increasing a pressure and speed of the fluid in an outlet.

A conventional high speed type impeller will now be explained with reference to the accompanying drawings.

FIG. 1 is a perspective view illustrating the conventional high speed type impeller, FIG. 2 is a perspective view illustrating the bottom surface of FIG. 1, and FIG. 3 is a structure view illustrating stress distribution in the high speed rotation of FIG. 1.

As illustrated in FIGS. 1 and 2, the conventional high speed type impeller includes a body 10 having a shaft coupling hole 11 at its center portion so that a rotation shaft (not shown) of a motor can be coupled into the shaft coupling hole 11, and being extended in the insertion direction of the rotation shaft to be bent along a plane surface perpendicular to the rotation shaft direction, and a plurality of blades 20 installed at the bent portion of the body 10 to be bent at a predetermined angle to the rotation shaft direction.

On the bottom surface of the impeller, a motor mounting guide 15 is downwardly protruded from a disk portion 10' of the body 10 to surround the circumference of the shaft coupling hole 11. The motor mounting guide 15 surrounds the motor inserted into the shaft coupling hole 11, thereby stably coupling the motor into the shaft coupling hole 11.

Normally, the conventional high speed type impeller is rotated at a speed of about 100,000 rpm. Such a speed exceeds a sound velocity. That is, very large centrifugal force is applied to the impeller. Therefore, the impeller needs sufficient durability to endure the centrifugal force.

However, as shown in FIG. 3, in the conventional high speed type impeller, stress concentration occurs at the center portion C of the body 10. As a result, cracks are generated at the center portion C, to damage the impeller.

Actually, when an impeller made of polyphenylene sulfide (PPS) was tested at 80,000 rpm, the maximum stress was about 146 MPa approximate to yield stress (150 MPa) of the PPS.

In this case, even if the rotation speed of the impeller slightly increases, the impeller may be damaged.

In order to prevent the impeller from being damaged by the cracks in the high speed rotation, functional plastic having a high formation temperature such as PEK is applied to the impeller to improve durability. However, since the functional plastic contains a high cost material, the manufacturing cost of the impeller increases.

There are thus increasing demands for a high speed type impeller which can cut down the unit cost of production and ensure durability, by using a low cost material and adding a supplementary device.

DISCLOSURE OF THE INVENTION

Therefore, an object of the present invention is to improve reliability of an impeller by cutting down the manufacturing cost and attaining durability in high speed rotation.

To achieve these and other advantages and in accordance with the purpose of the present invention, as embodied and broadly described herein, there is provided a high speed type impeller, including: a body having a shaft coupling hole into which a rotation shaft of a motor is coupled, the outer circumference of the body being widened from the top to bottom end in the insertion direction of the rotation shaft to form a bent surface; a plurality of blades installed on the bent surface of the body to be bent at a predetermined angle to the rotation shaft direction; and an upper reinforcing ring installed at the top end of the body.

In addition, there is provided a high speed type impeller, including: a body having a shaft coupling hole into which a rotation shaft of a motor is coupled, the outer circumference of the body being widened from the top to bottom end in the insertion direction of the rotation shaft to form a bent surface, a step portion being formed on the top end of the body; a plurality of blades installed on the bent surface of the body to be bent at a predetermined angle to the rotation shaft direction; and an upper reinforcing ring installed at the step portion of the body.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Hereinafter, a high speed type impeller according to the present invention will be explained in more detail with reference to the attached drawings.

Figure 1:
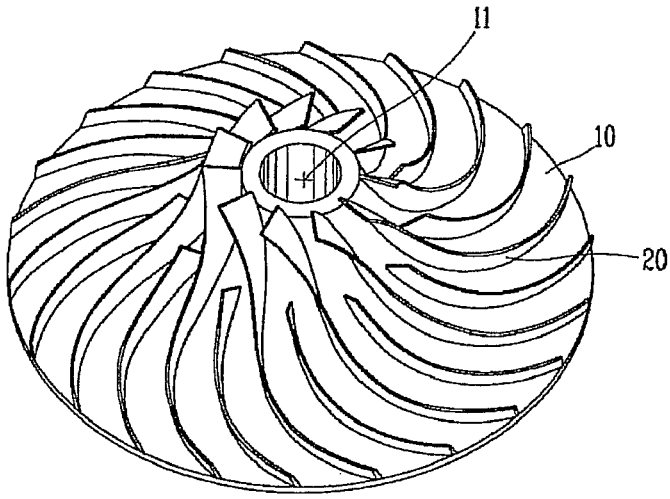
FIG. 1 is a perspective view illustrating a conventional high speed type impeller.
Figure 2:
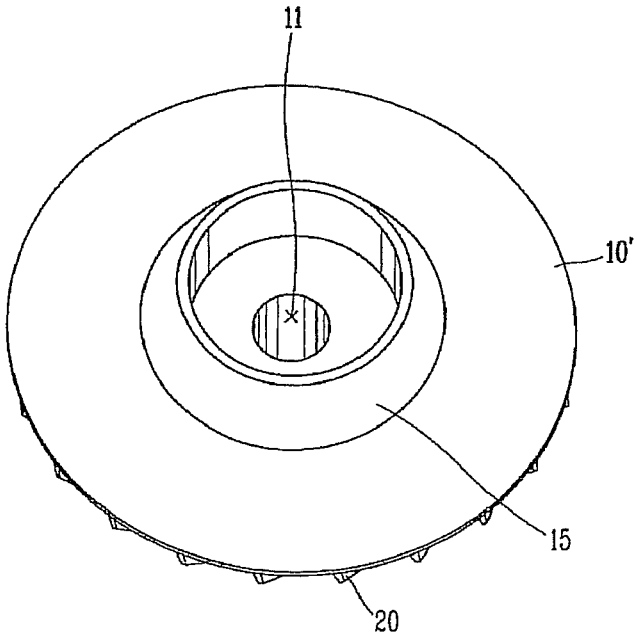
Prior Art FIG. 2
FIG. 2 is a perspective view illustrating the bottom surface of FIG. 1.
Figure 3:
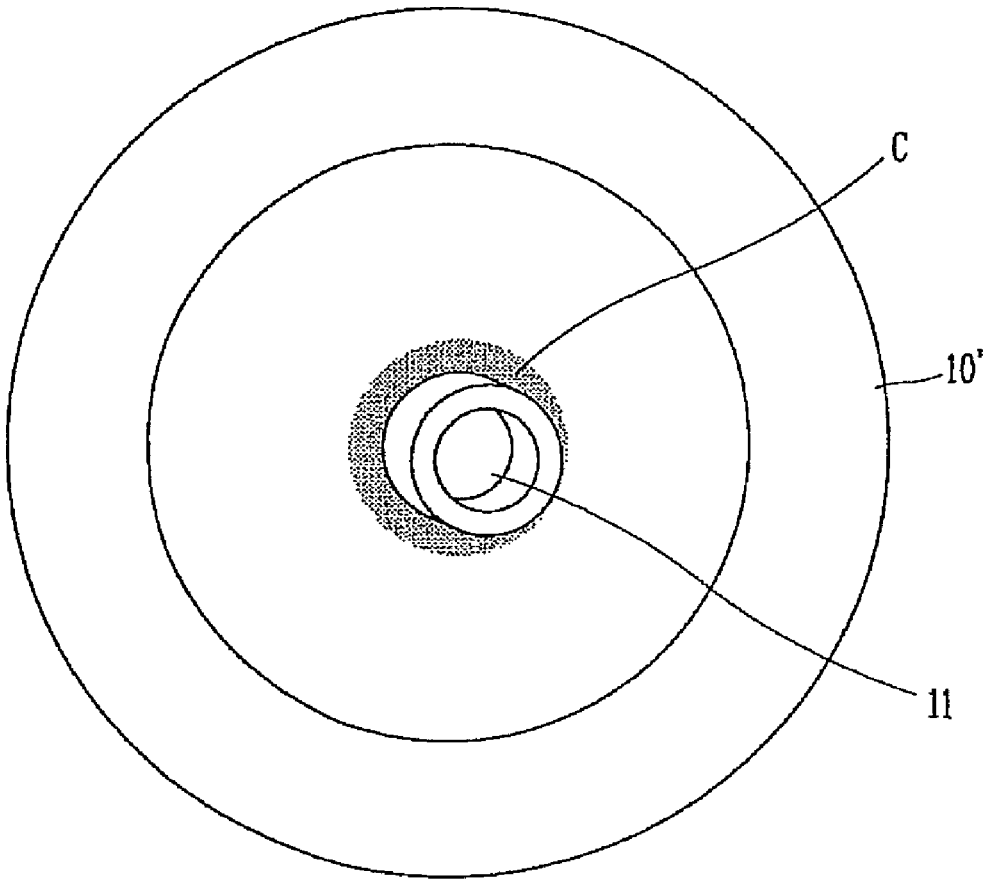
FIG. 3 is a structure view illustrating stress distribution in high speed rotation of FIG. 1.
Figure 4:
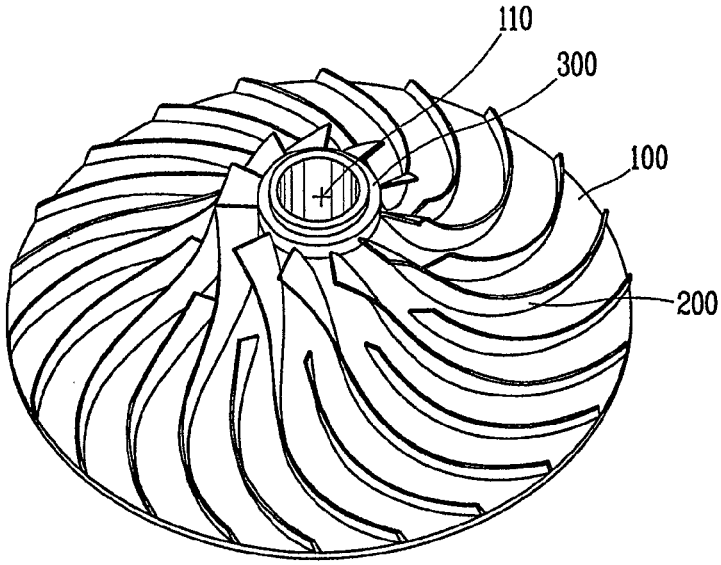
FIG. 4 is a perspective view illustrating a high speed type impeller in accordance with a preferred embodiment of the present invention.
Figure 5:
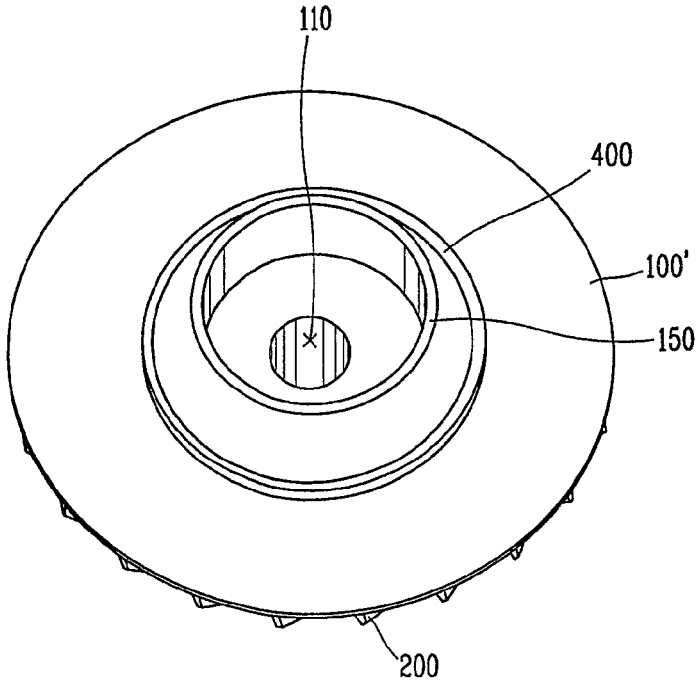
FIG. 5 is a perspective view illustrating the bottom surface of FIG. 4.
Figure 6:
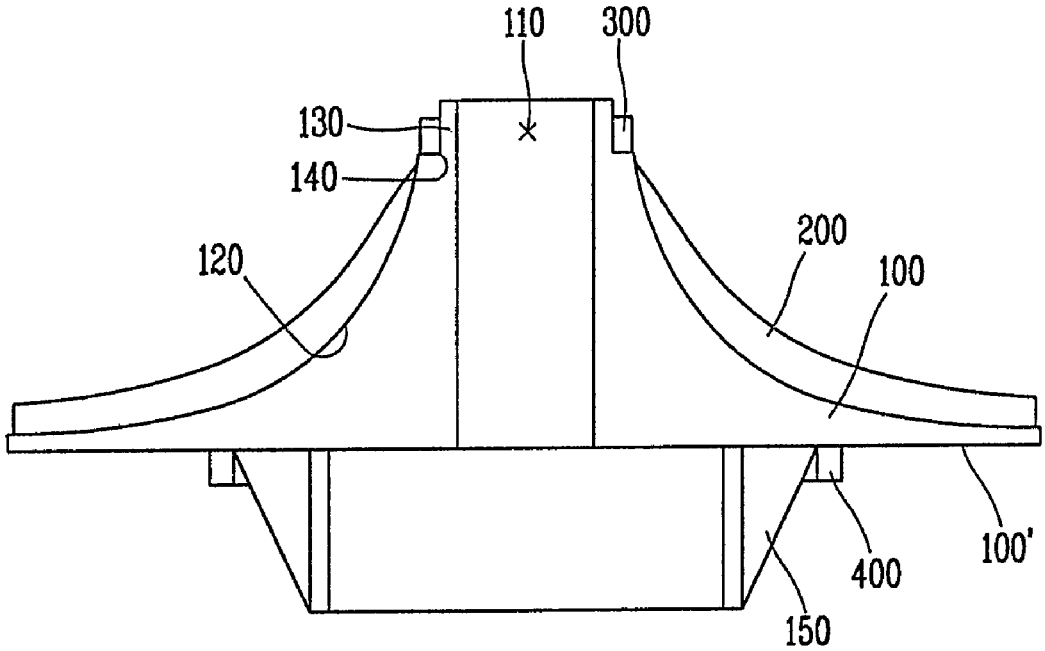
FIG. 6 is a vertical-sectional view illustrating the high speed type impeller of FIG. 4.

FIG. 4 is a perspective view illustrating a high speed type impeller in accordance with a preferred embodiment of the present invention, FIG. 5 is a perspective view illustrating the bottom surface of FIG. 4, and FIG. 6 is a vertical-sectional view illustrating the high speed type impeller of FIG. 4.

Referring to FIGS. 4 to 6, the high speed type impeller includes a body 100 having a shaft coupling hole 110 into which a rotation shaft (not shown) of a motor is coupled, the outer circumference of the body 100 being widened from the top to bottom end in the insertion direction of the rotation shaft to form a bent surface 120, a plurality of blades 200 installed on the bent surface 120 of the body 100 to be bent at a predetermined angle to the rotation shaft direction, and an upper reinforcing ring 300 installed at the top end of the body 100.

The body 100 is made of polyphenylene sulfide (PPS) which is relatively cheap engineering plastic.

At the center of the body 100, the shaft coupling hole 110 extended from the top to bottom end of the body passes through a center of a disk portion 100', and a motor mounting guide 150 is protruded from the circumference of the shaft coupling hole 110 to surround the shaft coupling hole 110.

An extended portion 130 which is extends from a top end of the bent surface 120 but has a uniform diameter extending from a step portion 140 in the radial direction is formed on the top end of the body 100.

Preferably, the extended portion 130 is extended higher than the top ends of the blades 200.

The upper reinforcing ring 300 made of a material having higher durability than the body 100 is fit-pressed onto the extended portion 130 in a ring shape to surround the extended portion 130. During the high speed rotation of the impeller, the upper reinforcing ring 300 serves to prevent the body 100 from being damaged by cracks by stress concentration on the top end of the body 100.

Preferably, the outer circumference of the upper reinforcing ring 300 corresponds to the top end of the bent surface 120. In addition, the upper reinforcing ring 300 has appropriate thickness not to interrupt the fluid flowing from the top end of the body 100 to the disk portion 100' along the blades 200 in driving.

In the high speed rotation of the impeller, stress may be concentrated on the motor mounting guide 150 protruded from the bottom surface of the body 100, to generate cracks.

To prevent damage of the impeller, a lower reinforcing ring 400 made of a material having higher durability than the body 100 is fit-pressed onto the motor mounting guide 150 to surround the outer circumference of the motor mounting guide 150.

Preferably, the lower reinforcing ring 400 is fit-pressed to touch the disk portion 100', for efficiently protecting the weak portion.

On the other hand, the upper reinforcing ring 300 and the lower reinforcing ring 400 can be incorporated with the body 100 by insert molding, instead of being fit-pressed onto the body 100.

In the above embodiment, the extended portion 130*c* which extends from the bent surface 120 and has a uniform diameter extending from the step portion 140 in the radial direction, is formed on the top end of the body 100.

However, the bent surface 120 can be extended to a predetermined direction on the top end of the body 100 without forming the step portion 140. In this case, the upper reinforcing ring 300 is coupled to the top end of the bent surface 120.

The operation effect of the high speed type impeller in accordance with the preferred embodiment of the present invention has been verified by the following test.

The test condition was identical to that of the conventional impeller. That is, the impeller was made of PPS which was cheaper than functional plastic such as PEK, and the rotation speed of the impeller was about 80,000 rpm.

According to the test result, the maximum stress was about 44 MPa at the center portion of the body 100. That is, the maximum stress was reduced to about 30% of the conventional one. In addition, the maximum stress was nothing but about 30% of the yield stress (150 MPa) of the PPS. Even if the rotation speed rises, the impeller can be stably operated.

As the reinforcing rings reinforce the weak portions of the impeller made of a low cost material with low yield stress, durability of the impeller is equivalent to or higher than that of the impeller made of a high cost material with high stress yield without using a supplementary structure such as the reinforcing ring.

The upper and lower reinforcing rings 300 and 400 can be made of various materials. In general, the upper and lower reinforcing rings 300 and 400 are made of steel or aluminum advantageous in price and processing.

As known from the above test result, even through the impeller is made of a low cost material, the reinforcing rings can reinforce the weak portions on which the stress is concentrated. The manufacturing cost of the impeller can be remarkably cut down by using the low cost material.

As a result, reliability of the impeller is attained with high economical efficiency.

The invention claimed is:

1. A high speed type impeller, comprising:

a disk shaped body having a shaft coupling hole into which a rotation shaft of a motor is coupled, an outer circumference of the body being widened from a top end to a bottom end thereof in an insertion direction of the rotation shaft so as to form a bent surface;

a plurality of blades installed on the bent surface of the body, wherein the plurality of blades are bent at a predetermined angle with respect to the rotation shaft; and an upper reinforcing ring installed at the top end of the body, surrounding and in contact with an outer circumferential surface of the shaft coupling hole.

2. The high speed type impeller as claimed in claim 1, further comprising:

a motor mounting guide that protrudes from a bottom surface of the body to surround the motor; and a lower reinforcing ring installed on an outer circumference of the motor mounting guide.

3. The high speed type impeller as claimed in claim 2, wherein the upper reinforcing ring and the lower reinforcing ring are installed by press fit.

4. The high speed type impeller as claimed in claim 3, wherein the upper reinforcing ring and the lower reinforcing ring are made of a material having higher durability than the body.

5. The high speed type impeller as claimed in claim 2, wherein the upper reinforcing ring and the lower reinforcing ring are installed by insert molding.

6. The high speed type impeller as claimed in claim 5, wherein the upper reinforcing ring and the lower reinforcing ring are made of a material having higher durability than the body.

7. The high speed type impeller as claimed in claim 2, wherein the upper reinforcing ring and the lower reinforcing ring are made of a material having higher durability than the body.

8. A high speed type impeller, comprising:

a body having a shaft coupling hole configured to receive a rotation shaft of a motor wherein an outer circumference of the body gradually increases from a top end to a bottom end thereof in an insertion direction of the rotation shaft so as to form a bent surface, and wherein a step portion is formed on the top end of the body;

a plurality of blades installed on the bent surface of the body, wherein the plurality of blades are bent at a predetermined angle with respect to the rotation shaft; and an upper reinforcing ring installed at the step portion of the body, surrounding and in contact with an outer circumferential surface of the shaft coupling hole.

9. The high speed type impeller as claimed in claim 8, further comprising:

a motor mounting guide that protrudes from a bottom surface of the body so as to define an installation space configured to receive the motor; and a lower reinforcing ring installed on an outer circumference of the motor mounting guide.

10. The high speed type impeller as claimed in claim 9, wherein the upper reinforcing ring and the lower reinforcing ring are installed by fit-pressing.

11. The high speed type impeller as claimed in claim 10, wherein the upper reinforcing ring and the lower reinforcing ring are made of a material having higher durability than the body.

12. The high speed type impeller as claimed in claim 9, wherein the upper reinforcing ring and the lower reinforcing ring are installed by insert molding.

13. The high speed type impeller as claimed in claim 12, wherein the upper reinforcing ring and the lower reinforcing ring are made of a material having higher durability than the body.

14. The high speed type impeller as claimed in claim 9, wherein the upper reinforcing ring and the lower reinforcing ring are made of a material having higher durability than the body.

15. The high speed type impeller as claimed in claim 8, wherein an outer circumference of the upper reinforcing ring is continuous with a top end of the bent surface of the body.

16. A high speed impeller, comprising:

a disk shaped body having a shaft coupling hole extending through a central portion thereof, the shaft coupling hole being configured to receive a shaft of a motor therein, wherein an outer circumference of the body increases gradually from a top end to a bottom end thereof so as to define a curved surface;

a plurality of blades installed on the curved surface of the body, at a predetermined angle with respect to an extension direction of the shaft coupling hole; and an upper reinforcing ring surrounding and in contact with an outer circumferential surface of a top end of the shaft coupling hole.

17. The high speed impeller of claim 16, further comprising:

a motor mounting guide that protrudes from a bottom surface of the body, at a portion thereof corresponding to the shaft coupling hole, wherein the motor mounting guide defines an installation space together with a corresponding portion of the bottom surface of the body, and wherein the installation space is configured to receive the motor therein; and a lower reinforcing ring surrounding an outer circumferential surface of the motor mounting guide, at a portion thereof that meets the bottom surface of the body.

18. The high speed impeller of claim 17, further comprising a stepped portion formed on the outer circumferential surface of the top end of the shaft coupling hole, wherein the upper reinforcing ring is seated on the stepped portion.

* * * * *